United States Patent [19]

Hayes

[11] Patent Number: 4,899,089

[45] Date of Patent: Feb. 6, 1990

[54] TIME-VARIABLE ILLUMINATING DEVICE

[76] Inventor: Dorothy E. Hayes, 30 E. 4th St., New York, N.Y. 10003

[21] Appl. No.: 106,980

[22] Filed: Oct. 2, 1987

Related U.S. Application Data

[63] Continuation of Ser. No. 863,801, May 9, 1986, abandoned.

[51] Int. Cl.[4] ..... H05B 37/00

[52] U.S. Cl. ..... 15/323; 315/312; 315/307; 315/324; 307/265

[58] Field of Search ..... 315/226, 294, 320, 224, 315/316, 297, 317, 324, 209 R, 323, 291, 210, 307

[56] References Cited

U.S. PATENT DOCUMENTS

| | | | |
|---|---|---|---|
| 3,684,882 | 8/1972 | Mininno et al. | 40/546 X |
| 3,778,676 | 12/1973 | Keller | 315/323 X |
| 3,909,669 | 9/1975 | White | 315/316 X |
| 3,916,253 | 10/1975 | Driscoll | 315/323 |
| 4,095,139 | 6/1978 | Symonds et al. | 315/294 |
| 4,215,277 | 7/1980 | Weiner et al. | 307/41 |
| 4,264,845 | 4/1981 | Bednarz | 315/323 |
| 4,284,926 | 8/1981 | Dinges | 315/312 |
| 4,388,567 | 6/1983 | Yamazaki et al. | 315/316 |
| 4,408,142 | 11/1983 | Wilje | 315/294 |
| 4,417,182 | 11/1983 | Weber | 315/317 |
| 4,475,298 | 10/1984 | Munoz | 40/546 |
| 4,593,232 | 6/1986 | McEdwards | 315/294 |

FOREIGN PATENT DOCUMENTS

| | | | |
|---|---|---|---|
| 1472480 | 10/1969 | Fed. Rep. of Germany | 40/546 |

*Primary Examiner*—Leo H. Boudreau
*Assistant Examiner*—Michael Razavi
*Attorney, Agent, or Firm*—Kane, Dalsimer, Sullivan, Kurucz, Levy, Eisele & Richard

[57] ABSTRACT

A circuit for controlling the intensity of several illuminating device includes a pulse generator which activates a ring counter. The ring counter activates consecutively one of its outputs in response to pulses from the generator. The ring counter outputs are connected to a wave shaping circuit which activates the illuminating devices in a predetermined manner.

2 Claims, 2 Drawing Sheets

TIME-VARIABLE ILLUMINATING DEVICE

This is a continuation of co-pending application Ser. No. 863,801 now abandoned, filed on May 9, 1986.

BACKGROUND OF THE INVENTION

This invention pertains to a time-variable circuit for activating a plurality of illuminating devices.

Recently artists, and more particularly painters and sculptors have started incorporating various light-generating or illuminating devices in their work as a means for achieving certain special aesthetic effects. Furthermore, it has been found that by time-varying the intensity of these devices the passage of time may be incorporated in these art works as a fourth dimension.

OBJECTIVES AND SUMMARY OF THE INVENTION

Accordingly the object of this invention is to provide a means of activating and changing the intensity of a plurality of illuminating devices adapted for use as a part of an artistic work.

A further objective is to provide a device assembled from standard and easily obtainable components. Other objects and advantages of the invention shall become apparent from the following description.

According to this invention, a time- varying illuminating device comprises a pulse generator, a means for selectively activating several devices in response to pulses generated by said pulse generator and a waveshaping circuit.

DESCRIPTION OF THE PREFERRED EMBODIMENT

Figures 1, 3, 4:
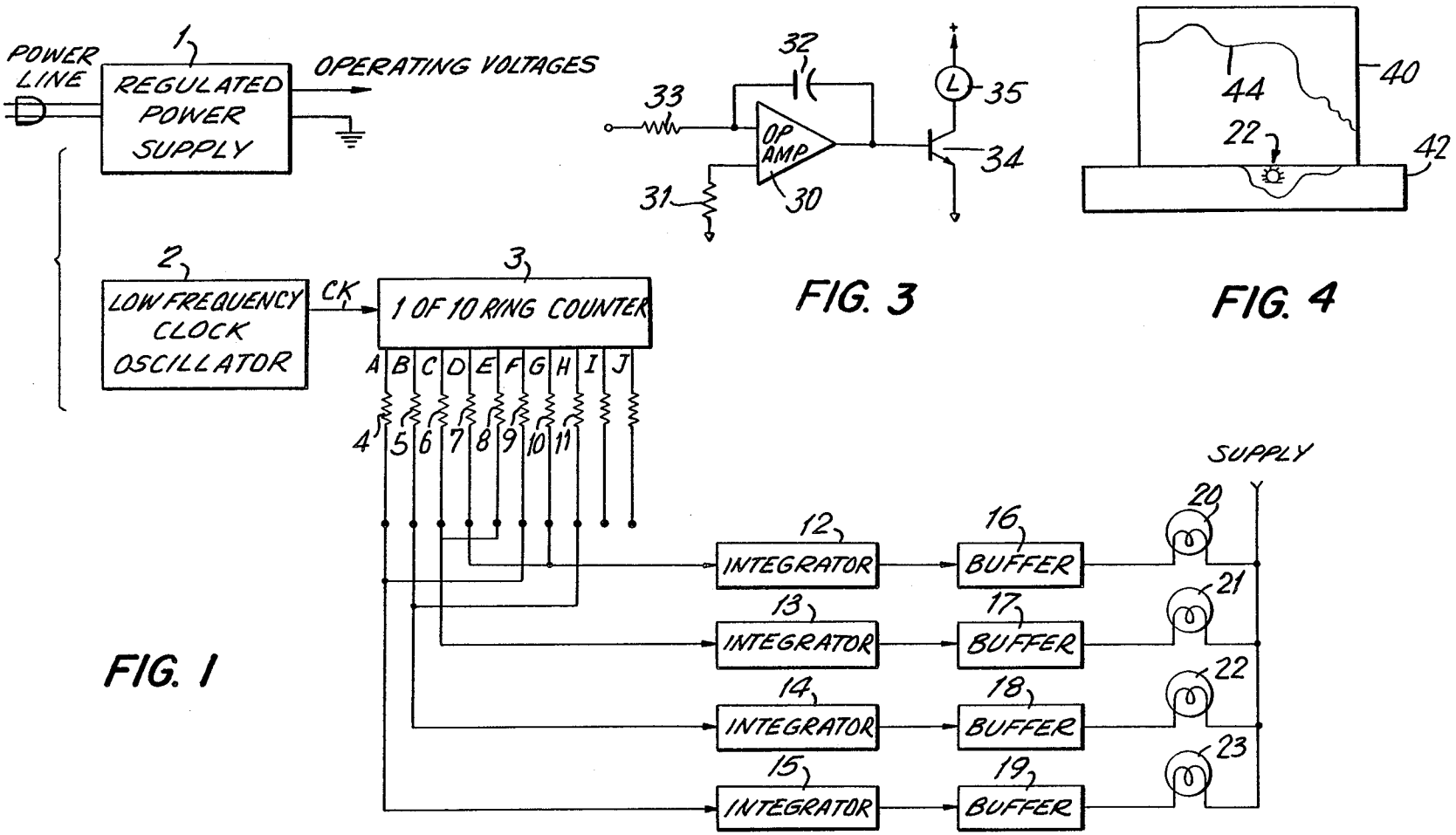
FIG. 1 shows the elements of the invention.
FIG. 3 shows a particular embodiment of some of the elements of FIG. 1.
FIG. 4 shows a partial sectional view of an artwork incorporating the invention.

As shown in FIG. 1, the subject device comprises a power supply 1, an oscillator 2, a ring counter 3, and several integrators 12–15. The power supply 1 converts power from a suitable source such as a standard a.c. power line into one or more d.c. voltages suitable for operating integrated circuits.

A low-frequency (0.5–2 sec) oscillator 2 is used to generate rectangular pulses. These pulses are used as are input to a ring counter 3. In response to these pulses the ring counter activates each one its outputs A-J sequentially for a period equal to the period of the pulses. Thus initially output A is turned on followed by outputs B,C,D and so on.

Figure 2:
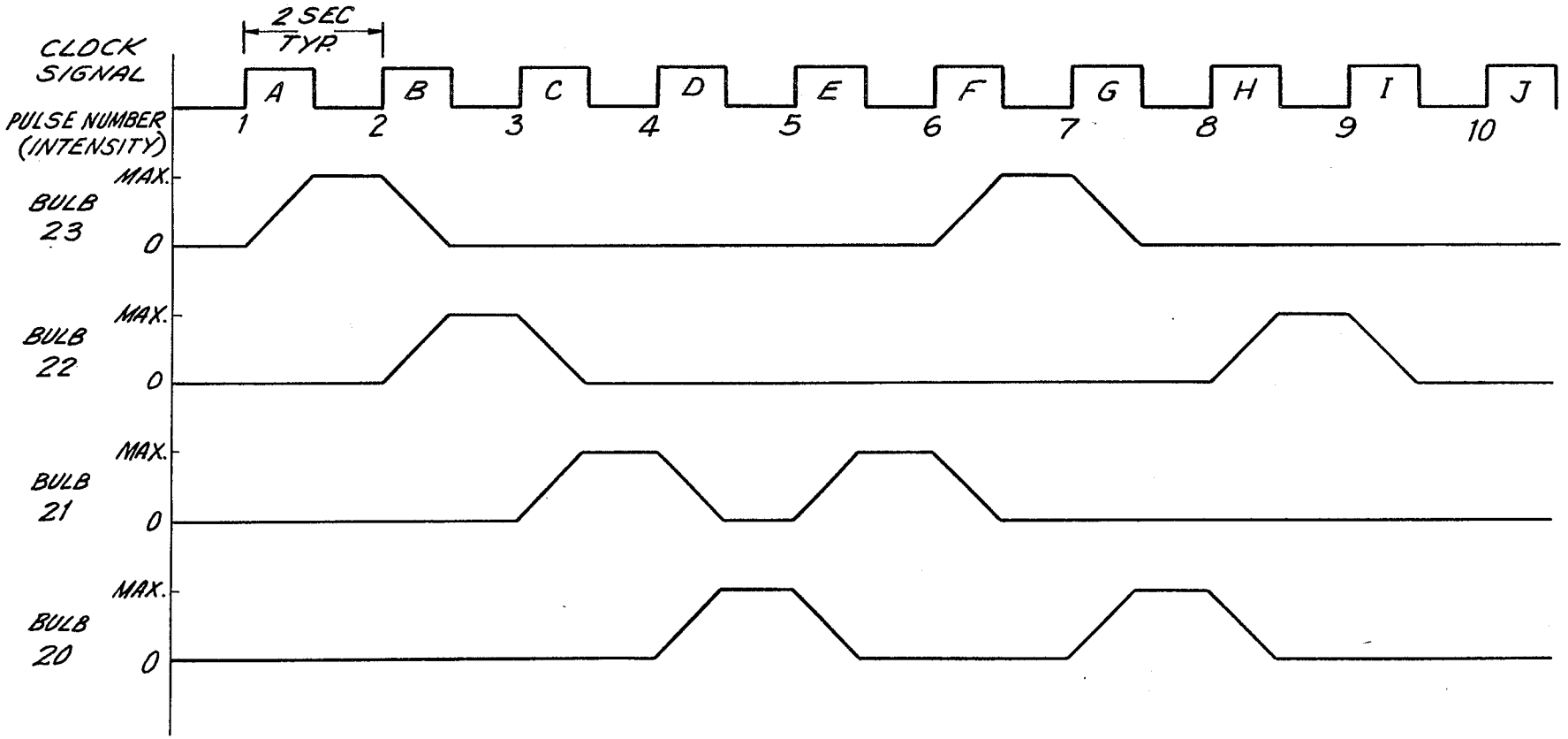
FIG. 2 shows the response of the device of FIG. 1.

Depending on the exact sequence and duration desired some of the outputs are connected to integrators 12–15 which generate a particular waveshape in conjunction with buffers 16–19 as shown in FIG. 2. The particular sequence of FIG. 2 is obtained by connecting outputs A,F; B,H;C,E; and D,G respectively to integrators 12–15. Integrators 12–15 cooperate with the respective buffers 16–19, so that when they are activated, respective lamps 20–23 gradually turn on until they achieve their maximum brightness and then their intensity is gradually diminished until they go off completely as shown in FIG. 2. By leaving some of the outputs such as I,J open, one may provide for a relaxation or quiescent period during which none of the lamps are ON. It is obvious that various effects can be achieved by connecting different lamps to different ring counter output.

Integrators 12–15 and buffers 16–19 are selected in accordance with the desired waveshape or illumination profile of a particular lamp such as the one manufactured by the General Electric Corporation under the designation GE 92. Obviously these elements need not be identical.

One way of implementing the integrator/buffer waveshaping stage is shown in FIG. 3. In this particular configuration one or more of the outputs of the ring counter 3 is/are connected to the inverting input of an operational amplifier 30 through a resistor 33. The resistor 33 is equivalent to the resistors 4–17 of the corresponding ring counter 3. The output of the amplifier is coupled to the inverting input through a capacitor 32. The non-inverting input of the amplifier is coupled to ground through a resistor 31. The values of capacitor 32 and resistor 33 are chosen so that in response to each rectangular pulse from counter 3, the amplifier generates a triangular pulse.

The output of the amplifier is connected to the base of a transistor 34. The emitter of the transistor is grounded. An illuminating device 35 has one terminal connected to a positive voltage supply, and a second terminal connected to the collector of the transistor. Effectively the transistor controls the current flowing through the illuminating device 35.

The circuit of FIG. 3 operates as follows. In response to a rectangular pulse from counter 3, the amplifier generates a rectangular, or possibly, trapezoidal pulse, i.e a pulse having a gradually rising leading edge and a gradual decreasing trailing edge. This pulse is fed to the base of the transistor. Initially, as its base voltage increases the transistor enters in its active region whereby its collector-to-emitter current is proportional to the base voltage. Thus the collector-to-emitter current increases, and subsequently the light emitted by device 35 increases in step with the base current. This process continues until the transistor saturates, at which point the device 35 reaches its maximum intensity. This intensity is maintained until the transistor base voltage drops below its saturation level and the transistor again enters its active stage. In this phase of the operation the device intensity again follows the base voltage, i.e. the amplifier output, until the transistor shuts off. Thus device 35 functions in accordance with the waveshapes shown in FIG. 2. Device 35 could be an incandescent lamp, a neon lamp, a light emitting diode or any other similar device.

FIG. 4 shows how the above-described circuit is used to illuminate a work of art. In this figure, a block 40 of a translucent or transparent material is mounted to a base 42. Within the block 40 one or more zones or planes 44 have been imbedded which may have a different density, index of refraction and/or color than block 40. Base 42 also serves to house the circuit of FIG. 1. Preferably the components of the circuit are normally hidden from view to highten the effect of the work and increase its aesthetic appeal. Bulbs 20–23 (only bulb 22 is shown) are arranged and disposed in the base in a manner so that their light output is substantially propagated into block 40. The changing intensities of these lights are reflected by block 40.

Obviously the invention could be implemented in numerous ways by one skilled in the art. Furthermore numerous modifications may be made without departing from the scope of the invention as defined in the appended claims.

What is claimed is:

1. A device comprising:

an opaque base having a plurality of light sources;

a translucent block secured to the base for illumination by said light sources, said block being partitioned into zones differentiated by different optical characteristics; and a control circuit disposed in said base for activating and deactivating said light sources in a preselected sequence; said control circuit comprising only:

a pulse generator for generating clock pulses;

a single ring counter operatively connected to said pulse generator, and having a plurality of outputs, each output being provided to generate output pulses sequentially in response to said clock pulses; and a plurality of integrators each being coupled to one of the light sources, each said integrator being connected directly to at least one ring counter output for generating a shaped pulse in response to a respective output pulse for activating said one of said light sources wherein the control circuit further comprises a buffer interposed between an integrator and a corresponding light source and wherein the integrator comprises an operational amplifier with an amplified output and the buffer comprises a transistor with a base connected to the amplifier output and a collector in series with said light source.

2. A device of claim 1 wherein said light source comprise light emitting diodes.

* * * * *